US008316474B2

(12) United States Patent
Kang

(10) Patent No.: US 8,316,474 B2
(45) Date of Patent: Nov. 27, 2012

(54) DRAINAGE APPARATUS FOR A SINK

(76) Inventor: Young Boung Kang, Gimhae-si (KR)

( * ) Notice: Subject to any disclaimer, the term of this patent is extended or adjusted under 35 U.S.C. 154(b) by 449 days.

(21) Appl. No.: 12/281,473

(22) PCT Filed: Mar. 16, 2007

(86) PCT No.: PCT/KR2007/001297

§ 371 (c)(1),
(2), (4) Date: Sep. 2, 2008

(87) PCT Pub. No.: WO2007/111429

PCT Pub. Date: Oct. 4, 2007

(65) Prior Publication Data

US 2009/0007321 A1 Jan. 8, 2009

(30) Foreign Application Priority Data

Mar. 29, 2006 (KR) ..... 10-2006-0028390

(51) Int. Cl.
*E03C 1/26* (2006.01)

(52) U.S. Cl. ..... 4/287; 4/292

(58) Field of Classification Search ..... 4/287–293, 4/295, 650–653

See application file for complete search history.

(56) References Cited

U.S. PATENT DOCUMENTS

| | | | | |
|---|---|---|---|---|
| 3,333,282 | A * | 8/1967 | Mustee | 4/640 |
| 5,201,340 | A * | 4/1993 | Teepe | 137/315.18 |
| 5,784,725 | A * | 7/1998 | Joiner | 4/295 |
| 6,049,921 | A * | 4/2000 | Erbs | 4/650 |
| 6,058,526 | A | 5/2000 | Parisi et al. | |
| 7,370,665 | B2 * | 5/2008 | Smith et al. | 137/399 |
| 7,472,435 | B2 * | 1/2009 | Havens | 4/679 |

FOREIGN PATENT DOCUMENTS

| | | |
|---|---|---|
| JP | 55-050151 | 4/1980 |
| JP | 55-050151 A | 4/1980 |
| JP | 09-013462 A | 1/1997 |
| JP | 2003-286735 A | 10/2003 |
| KR | 20-0305366 | 2/2003 |
| KR | 20-0368837 | 11/2004 |

* cited by examiner

*Primary Examiner* — Charles Phillips
(74) *Attorney, Agent, or Firm* — Park & Associates IP Law, P.C.

(57) ABSTRACT

The present invention relates to a drainage apparatus for a sink, in which it is possible to drain wash water rapidly without having residue substances such as foreign substances and the like caught thereon, and prevent leakage of malodor in advance, thereby achieving excellent cleanliness, facilitating an operation and maintenance of the drainage apparatus due to its simple configuration and structure. Thus, according to the drainage apparatus for a sink of the invention, residue substances, foreign substances and the like are not caught on the drainage apparatus, the female screw-shaped grooves induce vortex of wash water, thereby rapidly draining the wash water, and the float ball made of positive buoyancy material is insertingly mounted inside of the tubular drainage body so as to ascend or descend by means of the wash water, thereby preventing leakage of malodor in advance, achieving excellent cleanliness, and facilitating an assembling operation and maintenance/repair of the drainage apparatus due to its simple configuration and structure.

8 Claims, 6 Drawing Sheets

[Fig. 3]
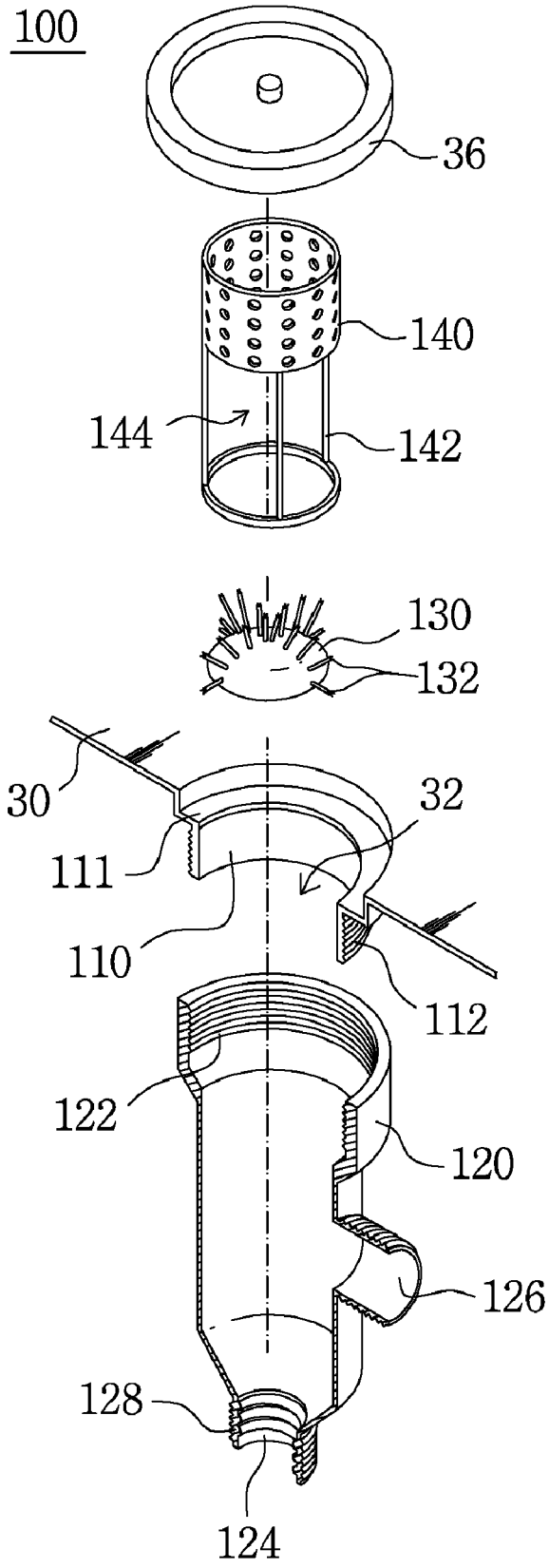

[Fig. 4]
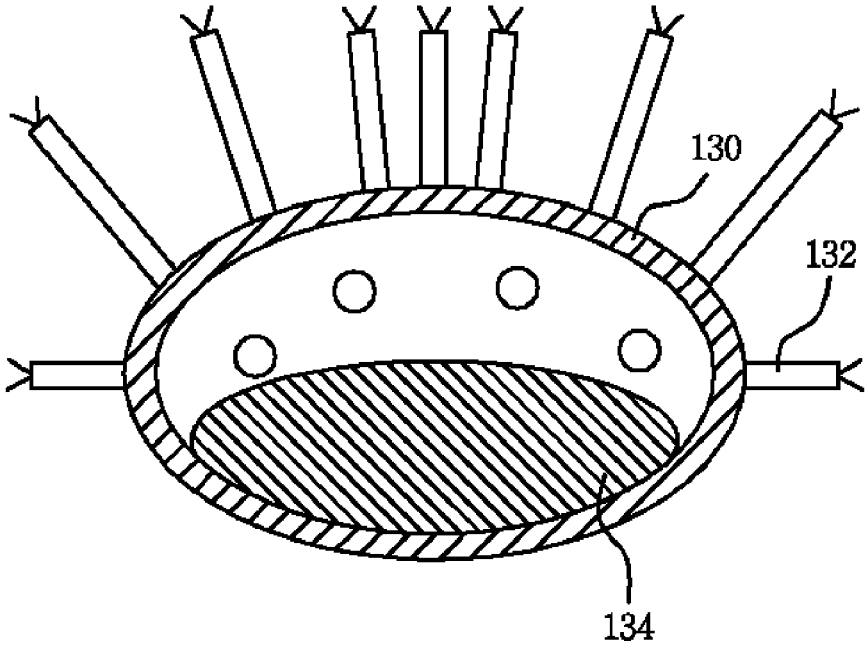

[Fig. 5]
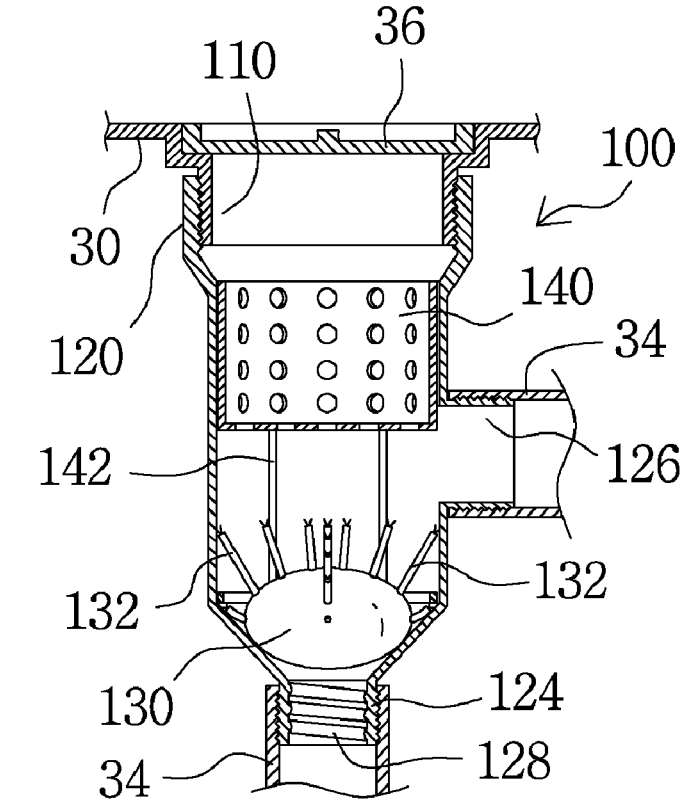
(A)
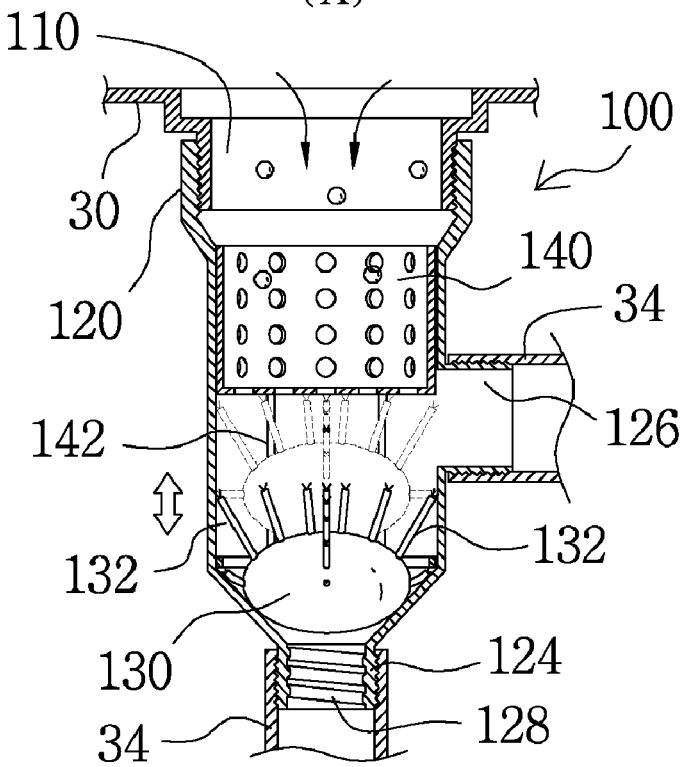
(B)

[Fig. 6]
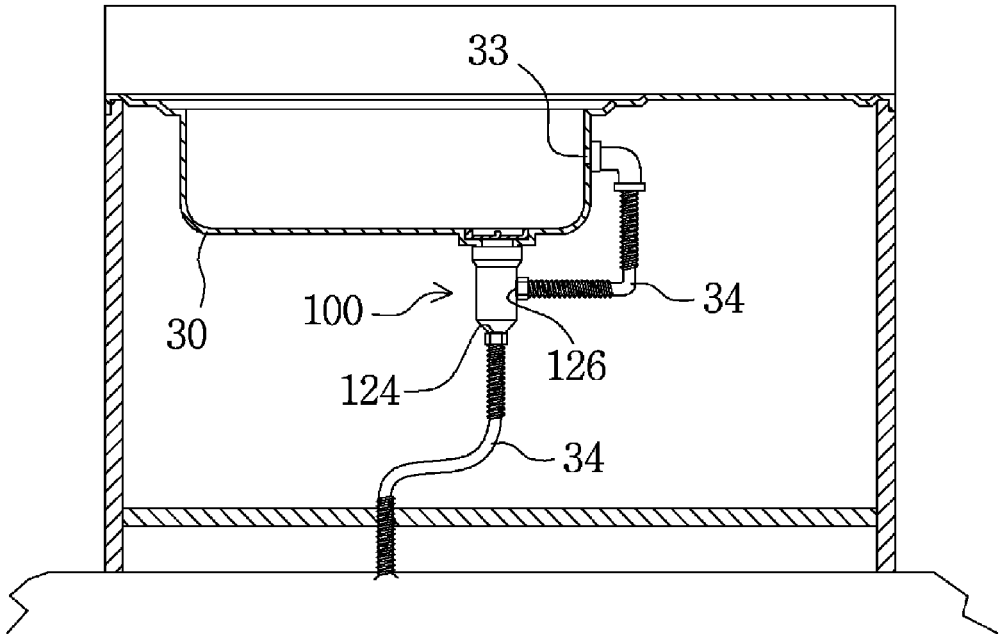

DRAINAGE APPARATUS FOR A SINK

TECHNICAL FIELD

The present invention relates to a drainage apparatus for a sink, and more particularly to a drainage apparatus for a sink in which it is possible to drain wash water rapidly without having residue substances such as foreign substances and the like caught thereon, and prevent leakage of malodor in advance, thereby achieving excellent cleanliness, facilitating an operation and maintenance of the drainage apparatus due to its simple configuration and structure.

BACKGROUND ART

Generally, a sink installed in the kitchen is an indispensable article used for various purposes such as washing vessel, fruit, vegetables and the like.

In a configuration of such a sink, the sink comprises: a main body including at least one basin for allowing vessel, fruit, vegetables and the like to be washed therein, and w ater to be stored therein, the basin having a drainage hole formed on the bottom surface of the basin for permitting water drainage therethrough, and a water level control drainage hole formed at a side surface of the basin for preventing water from the basin from being overflowed; and a drainage apparatus mounted to the drainage hole of the main body for filtering food residue and discharging wash water to the sanitary sewer.

Particularly, the drainage apparatus is a significantly important configuration component of the sink so as to allow food residue to be filtered therethrough, wash water to be discharged therethrough, and leakage of malodor to be prevented.

In the prior art, a number of drainage apparatuses as constructed above have been disclosed. FIG. 1 is an exploded perspective view showing a part of a conventional drainage apparatus, and FIG. 2 is a side cross-sectional view showing a state where the conventional drainage apparatus is assembled.

Referring to FIGS. 1 and 2, a drainage apparatus 10 comprises a pair of annular packings 12 disposed on the top and underside surfaces of an annular rim defining the drainage hole 32 of the main body 30, an annular fixing plate 14 fittingly inserted into the drainage hole 32 from the above downward, a tubular drainage body 16 screw-coupled to the fixing plate 14, and a drainage member 22 insertingly mounted inside the tubular drainage body 16 for preventing leakage of malodor. The drainage apparatus 10 further comprises a filtering mesh 24 seated on an annular retaining step 15 formed on the inner peripheral surface of the fixing plate 14, and a cover 36 for covering the filtering mesh 24 and the inside of the tubular drainage body 16.

The tubular drainage body 16 penetratingly formed in a vertical direction includes a lower connection portion 18 formed on the lower portion thereof so as to be screw-coupled to a hose 34 through which wash water is transported, and a side connection portion 20 formed on the peripheral side surface thereof so as to be screw-coupled to a hose 34 communicating with a water level control drainage hole 33.

In accordance with configuration of the conventional drainage apparatus as constructed above, the presence of a fine gap formed on the annular rim defining the drainage hole 32 of the main body 30, namely, the coupling contact surface of the fixing plate 14 and the pair of packings 12 causes a problem such that small-sized food residues are kept being caught between the gap. As a result, an unsanitary problem is created due to proliferation of various bacteria at the gap with food residues caught therebetween. Also, it has a difficulty in an operation and maintenance due to its complicate configuration and structure.

DISCLOSURE OF INVENTION

Technical Problem

Accordingly, the present invention has been made in an effort to solve the above-mentioned problems occurring in the conventional art, and it is an object of the present invention to provide a drainage apparatus for a sink, in which it is possible to drain wash water rapidly without having residue substances such as foreign substances and the like caught thereon, and prevent leakage of malodor in advance, thereby achieving excellent cleanliness, facilitating an operation and maintenance of the drainage apparatus due to its simple configuration and structure.

Technical Solution

To achieve the above object, according to the invention, there is provided a drainage apparatus for a sink comprising a main body provided with a drainage hole formed thereon; a tubular drainage body screw-coupled to the drainage hole for allowing a transportation hose to be connected to a lower portion thereof; a filtering mesh for filtering food residue therethrough; and a cover for covering the drainage hole, wherein the main body includes an annular retaining step integrally formed on an inner peripheral wall of the drainage hole thereof in such a manner as to be downwardly bent inwardly from the inner peripheral wall of the drainage hole so as to allow the cover to be seated thereon, and a coupling member downwardly extending from the lower end of the annular retaining step and having a male screw portion formed on the outer peripheral surface thereof so as to allow the tubular drainage body to be screw-coupled thereto.

Preferably, the tubular drainage body is penetratingly formed in such a manner as to be stepwisely narrower in diameter as it goes from the top to the bottom and has a plurality of female screw-shaped grooves formed on the inner peripheral wall surface of the lower portion thereof so as to induce vortex of wash water passing therethrough while dropping down.

In addition, the drainage apparatus for a sink further comprises a float ball made of positive buoyancy material insertingly mounted inside of the tubular drainage body and adapted to clog off the lower end portion of the tubular drainage body to allow the wash water to be discharged by the ascent of the float ball due to the buoyancy created when the wash water drops into the tubular drainage body.

Further, the filtering mesh includes a plurality of pillars downwardly extending from the lower annular edge thereof so as to define a space portion therein, so that the float ball ascends or descends in the space portion, and the plurality of pillars is seated on the inner lower portion of the tubular drainage body.

Preferably, the float ball includes a cleaning brush formed on the outer peripheral surface thereof so as to clean the inner peripheral wall of the tubular drainage body when the float ball ascends and descends in the space portion of the filtering mesh.

BRIEF DESCRIPTION OF THE DRAWINGS

Further objects and advantages of the invention can be more fully understood from the following detailed description taken in conjunction with the accompanying drawings, in which:

FIG. 3 is an exploded perspective view showing a state where a part of a drainage apparatus for a sink is cut according to a preferred embodiment of the present invention;

FIG. 4 is a cross-sectional view of a float ball according to a preferred embodiment of the present invention;

FIGS. 5(A) and 5(B) are cross-sectional views schematically showing an operation of a drainage apparatus for a sink according to a preferred embodiment of the present invention and FIG. 6 is a schematic use state view of a drainage apparatus for a sink according to a preferred embodiment of the present invention.

BEST MODE FOR CARRYING OUT THE INVENTION

Figure 1:
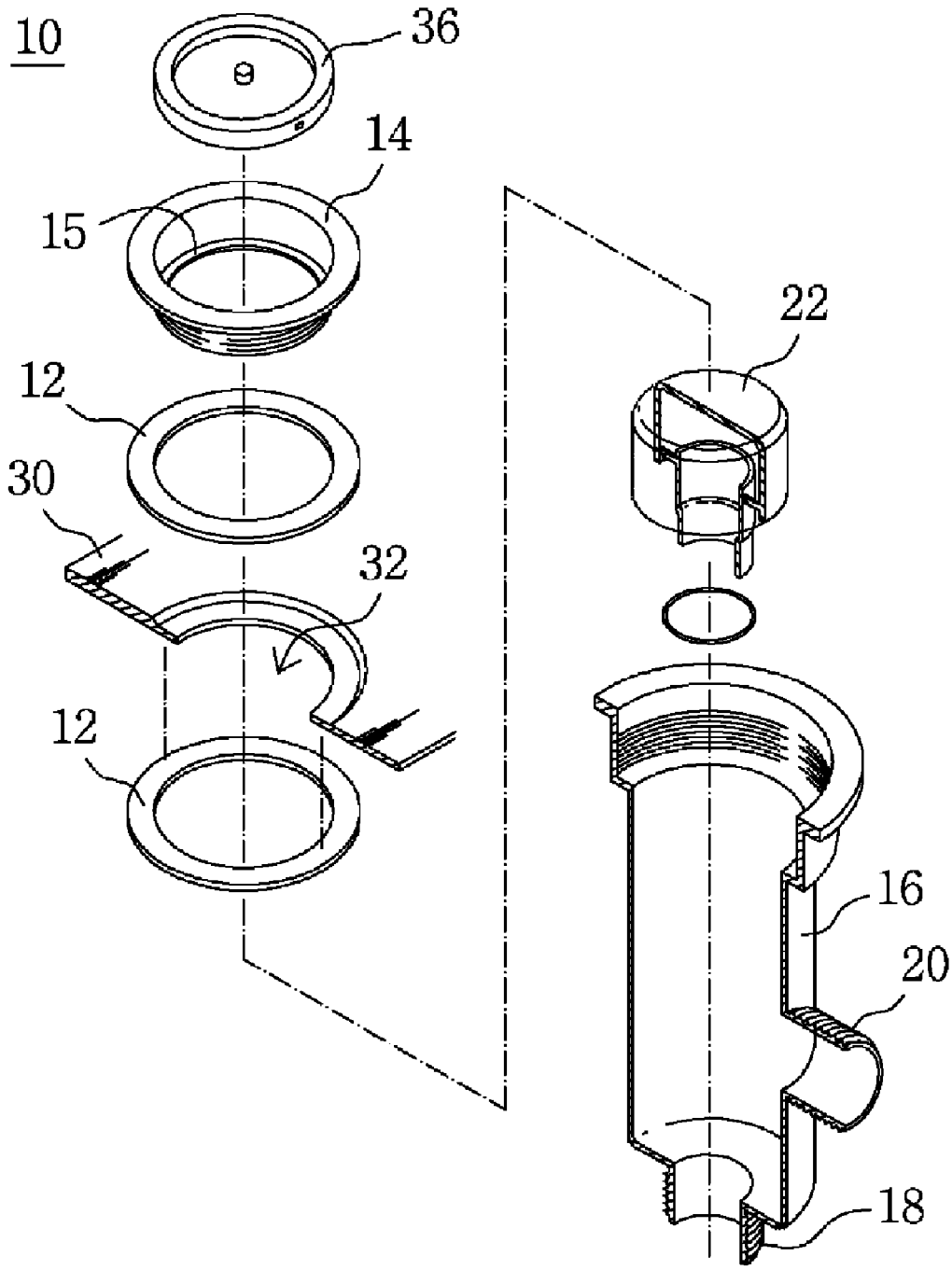
Fig. 1 (PRIOR ART)
FIG. 1 is an exploded perspective view showing a state where a part of a conventional drainage apparatus is cut.
Figure 2:
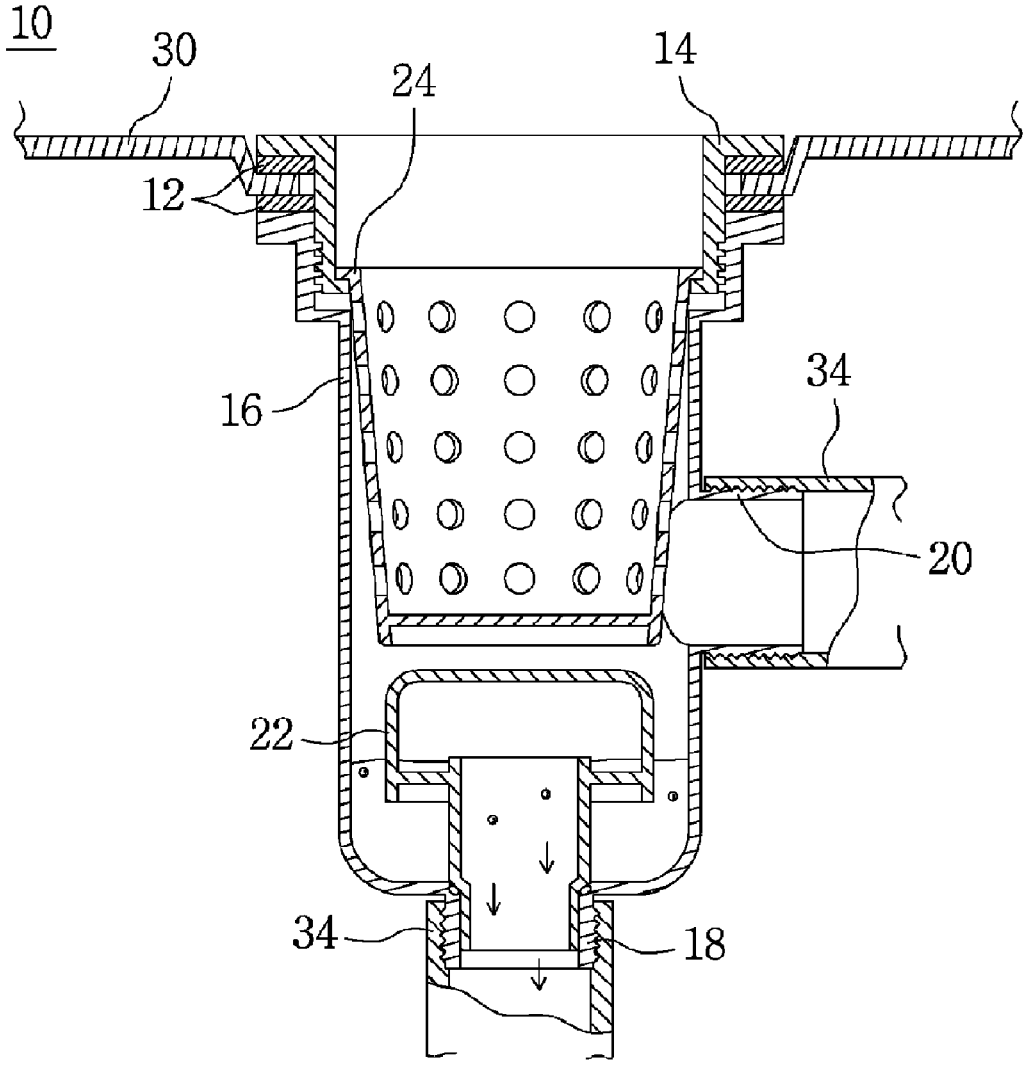
Fig. 2 (PRIOR ART)
FIG. 2 is a side cross-sectional view showing a state where the conventional drainage apparatus is assembled.

Hereinafter, a preferred embodiment of the invention will be described in detail with reference to the appended drawings.

FIG. 3 is an exploded perspective view showing a state where a part of a drainage apparatus for a sink is cut according to a preferred embodiment of the present invention, and FIG. 4 is a cross-sectional view of a float ball according to a preferred embodiment of the present invention.

Referring to drawings, a drainage apparatus for a sink 100 comprises a coupling member 110 integrally formed on a lower portion of a drainage hole 32 of a sink main body 30, a tubular drainage body 120 screw-coupled to the coupling member 110, a float ball 130 insertingly mounted inside the tubular drainage body 120 and positioned on the lower portion of the tubular drainage body 120, and a filtering mesh 140 for filtering food residue therethrough. An annular retaining step 111 is integrally formed on an inner peripheral wall defining the drainage hole 32 in such a manner as to be downwardly bent inwardly from the inner peripheral wall of the drainage hole so as to allow a cover 36 to be seated thereon, and the coupling member 110 downwardly extending from the lower end of the annular retaining step 111 and having a male screw portion formed on the outer peripheral surface thereof so as to allow the tubular drainage body 120 to be screw-coupled thereto.

At this time, preferably, the coupling member 110 is formed integrally with the main body 30 by downwardly extending from the lower end of the annular retaining step 111 at the time of forming the drainage hole 32. However, it is possible for the coupling member 110 to be separately fabricated, and then bonded to the drainage hole 32 by the spot welding method.

Here, it should be appreciated that a conventional tubular drainage body 16 can be of course screw-coupled to the coupling member 110 of the drainage hole 32 in another preferred embodiment of the invention.

The tubular drainage body 120 is penetratingly formed in such a manner as to be stepwisely narrower in diameter as it goes from the top to the bottom and has a female screw portion 122 formed on the inner peripheral surface of the upper portion thereof so as to be screw-coupled to the male screw portion 112 of the coupling member 110.

The tubular drainage body 120 includes a lower connection portion 124 formed on the lower portion thereof so as to be screw-coupled to a hose 34 through which wash water is transported, and a side connection portion 126 formed on the peripheral side surface thereof so as to be screw-coupled to a water level control drainage hole 33 of the main body 30.

Further, the tubular drainage body 120 includes a plurality of female screw-shaped grooves 128 formed on the inner peripheral surface of the lower end portion thereof so as to induce vortex of wash water when the wash water drops therein. Here, the female screw-shaped grooves 128 is intended so as to wash the inner wall of the lower portion of the tubular drainage body 120 when the wash water is discharged through the lower connection portion 124 of the tubular drainage body 120. At this time, although a plurality of protrusions are intermittently formed on the inner peripheral surface of the lower end portion of the tubular drainage body 120 instead of the grooves 128, it is possible to achieve the same effect as in the case where the grooves 128 is formed thereon.

The float ball 130 made of positive buoyancy material is insertingly mounted inside the tubular drainage body 120 so as to cover the lower portion of the tubular drainage body 120, thereby preventing leakage of the malodor flowing backward from the lower portion of the tubular drainage body 120. (see FIG. 4) Further, the float ball 130 includes a cleaning brush 132 intermittently formed on the outer peripheral surface thereof so as to clean the inner peripheral wall of the tubular drainage body 120 when the float ball 130 ascends and descends.

In other words, the float ball 130 is implemented such that it usually clogs off the lower end portion of the tubular drainage body 120 by its own weight, and it ascends due to the buoyancy created when the wash water drops into the tubular drainage body 120. In addition, the float ball 130 further has a weight 134 of a predetermined load formed therein so as to allow the float ball 130 to ascend and descend in a rapid and safe manner.

Meanwhile, the filtering mesh 140 includes a plurality of small holes formed on the outer peripheral surface thereof so as to allow wash water to pass therethrough and food residue to be filtered thereon, and a plurality of pillars 142 downwardly extending from the lower annular edge thereof so as to define a space portion 144 therein, so that the float ball 130 ascends or descends in the space portion 144. At this time, the plurality of pillars 142 has a lower annular rim formed at the lower ends thereof so as to impart a sense of stability thereto. The filtering mesh 140 as constructed above is not seated on the upper portion of the tubular drainage body 120 but insertingly mounted inside the tubular drainage body 120 to be seated on the lower portion of the tubular drainage body 120, so that a part of the filtering mesh 140 on which food residue is caught can be minimized.

FIGS. 5(A) and 5(B) are cross-sectional views schematically showing an operation of a drainage apparatus for a sink according to a preferred embodiment of the present invention; and FIG. 6 is a schematic use state view of a drainage apparatus for a sink according to a preferred embodiment of the present invention.

Referring to FIG. 5(A), in accordance with the assembly of configuration components of the drainage apparatus, the tubular drainage body 120 is screw-coupled to the male screw portion 112 of the coupling member 110 formed on the lower portion of the drainage hole 32 of the main body 30, and then the float ball 130 and the filtering mesh 140 are insertingly mounted inside the tubular drainage body 120 in that order, thereby completing the assembly. Thus, simple configuration and structure of the drainage apparatus 100 of the invention permits its easy operation and maintenance.

Meanwhile, a typical sealing tape is wrapped around the male screw portion 112 of the coupling member 110 or an adhesive is applied to the male screw portion 112, and then the male screw portion 112 is screw-coupled to the female screw portion of the tubular drainage body 120, thereby assuring excellent water-tightness therebetween.

Therefore, since the drainage hole 32 of the main body 30 and the tubular drainage body 120 do not have any protrusive surface formed thereon such as a latched protrusion, and a coupling contact surface of the drainage hole 32 and the tubular drainage body 120 to each other is not exposed to the outside, foreign substances are not caught therebetween when wash water is discharged therethrough.

Here, referring to FIG. 5(B), when wash water is discharged into the tubular drainage body 120 from the main body 30, food residue is filtered on the filtering mesh 140 and the wash water passes therethrough to drop into the tubular drainage body 120. At this time, when the wash water drops to the lower portion of the tubular drainage body 120, the float ball 130 ascends due to the buoyancy, and the wash water is discharged through the lower connection portion 124.

Here, since the float ball 130 ascends and descends in the space portion 144 according to the amount of wash water due to the buoyancy and its own weight, the inner peripheral wall of the tubular drainage body 120 and the lower inner peripheral surface of the filtering mesh 140 is washed by the vertical movement of the cleaning brush 132 formed on the outer periphery surface of the floatball 130. Further, the wash water dropping to the lower connection portion 124 is rapidly discharged while washing the lower portion of the tubular drainage body 120, since vortex of wash water is induced by the female screw-shaped grooves 128.

Meanwhile, when the wash water remained in the tubular drainage body 120 is discharged through the lower connection portion 124 after completing the dropping of the wash water, the float ball 130 downwardly drops due to its own weight to cover the lower portion of the tubular drainage body 120, thereby preventing leakage of the malodor from flowing backward.

As shown in FIG. 6 which is a use state view of the drainage apparatus of the invention, the drainage apparatus 100 as described above is installed to the main body 30. The lower connection portion 124 and the side connection portion 126 of the drainage apparatus 100 are screw-coupled to the hose 34 through which wash water is transported to the sanitary sewer, and the hose 34 communicating with the water level control drainage hole 33, respectively.

Thus, according to the drainage apparatus 100, since a contact surface or connection part of the drainage hole 32 and the tubular drainage body 120 is not exposed to the outside, foreign substances are not caught therebetween. Further, the vortex of wash water is induced by the female screw-shaped grooves 128, thereby allowing the wash water to be rapidly drained, and the float ball 130 of positive buoyancy material insertingly mounted inside the tubular drainage body 120 ascends and descends by the wash water, thereby preventing leakage of malodor in advance. As a result, the assembly operation and maintenance of the drainage apparatus 100 is facilitated due to its simple configuration and structure.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

As described above according to the present invention, since a contact surface or connection part of the drainage hole and the tubular drainage body is not exposed to the outside, foreign substances are not caught therebetween. Further, the female screw-shaped grooves induce vortex of wash water, thereby rapidly draining the wash water, and the float ball made of positive buoyancy material is insertingly mounted inside of the tubular drainage body so as to ascend or descend by means of the wash water, thereby preventing leakage of malodor in advance, achieving excellent cleanliness, and facilitating an assembling operation and maintenance/repair of the drainage apparatus due to its simple configuration and structure.

The invention claimed is:

1. A drainage apparatus for a sink, comprising:

a main body having a drainage hole formed thereon, the main body including an annular retaining step formed on an inner peripheral wall defining the drainage hole, and a coupling member formed unitarily with the main body and extending downwardly from the annular retaining step and having a male screw portion on an outer surface of the coupling member;

a tubular drainage body having a female screw portion screw-coupled to the male screw portion of the coupling member, and a transportation hose for connecting to a lower portion of the tubular drainage body;

a filtering mesh for filtering water from residue substances in the sink; and a cover for covering the drainage hole with the cover seated on the annular retaining step, wherein the filtering mesh includes a plurality of pillars extending downwardly from a lower annular edge thereof so as to define a space portion therein for receiving a float ball therein, and the plurality of pillars are seated on an inner lower portion of the tubular drainage body.

2. The drainage apparatus according to claim 1, wherein the tubular drainage body is shaped to be stepwisely narrower in diameter as it goes from the top to the bottom and has a plurality of grooves formed on the inner peripheral wall surface of the lower portion thereof so as to induce vortex of water passing therethrough while dropping down.

3. The drainage apparatus according to claim 1, wherein the float ball is made of buoyancy material and configured to shut off the lower end portion of the tubular drainage body and also to allow the water to be discharged as the float ball ascends by the buoyancy created when the water drops or fills into the tubular drainage body.

4. The drainage apparatus according to claim 2, wherein the float ball is made of buoyancy material and configured to shut off the lower end portion of the tubular drainage body and also to allow the water to be discharged as the float ball ascends by the buoyancy created when the water drops or fills into the tubular drainage body.

5. The drainage apparatus according to claim 3, wherein the float ball includes a cleaning brush on the outer peripheral surface thereof so as to clean the inner peripheral wall of the tubular drainage body when the float ball ascends and descends in the space portion of the filtering mesh.

6. A drainage apparatus for a sink, comprising:

a main body having a drainage hole formed thereon, and a coupling member extending downwardly from the drainage hole portion and having a male screw portion on an outer surface of the coupling member;

a tubular drainage body having a female screw portion screw-coupled to the male screw portion of the coupling member, and a transportation hose for connecting to a lower portion of the tubular drainage body;

a filtering mesh for filtering water from residue substances in the sink; and a float ball made of buoyancy material and received in the tubular drainage body, the float ball configured to shut off the lower end portion of the tubular drainage body and also to allow the water to be discharged as the float ball ascends by the buoyancy created when the water drops or fills into the tubular drainage body, the float ball including a cleaning brush on the outer peripheral surface thereof so as to clean the inner peripheral wall of the tubular drainage body when the float ball ascends and descends in the space portion of the filtering mesh.

7. The drainage apparatus according to claim 6, wherein the main body further comprises an annular retaining step formed on an inner peripheral wall defining the drainage hole, and a cover for covering the drainage hole by seating on the annular retaining step.

8. The drainage apparatus according to claim 6, wherein the filtering mesh includes a plurality of pillars extending downwardly from the lower annular edge thereof so as to define a space portion therein, and the plurality of pillars are seated on an inner lower portion of the tubular drainage body.

* * * * *